US006710748B2

(12) United States Patent
Yarasi et al.

(10) Patent No.: US 6,710,748 B2
(45) Date of Patent: Mar. 23, 2004

(54) COMPACT DUAL BAND CIRCULAR PIFA

(75) Inventors: Sripathi Yarasi, Lincoln, NE (US); Govind R. Kadambi, Lincoln, NE (US); Theodore S. Hebron, Lincoln, NE (US)

(73) Assignee: Centurion Wireless Technologies, Inc., Lincoln, NE (US)

( * ) Notice: Subject to any disclaimer, the term of this patent is extended or adjusted under 35 U.S.C. 154(b) by 0 days.

(21) Appl. No.: 10/341,862

(22) Filed: Jan. 14, 2003

(65) Prior Publication Data

US 2003/0231134 A1 Dec. 18, 2003

Related U.S. Application Data

(60) Provisional application No. 60/390,027, filed on Jun. 18, 2002.

(51) Int. Cl.[7] ..... H01Q 1/24; H01Q 1/38

(52) U.S. Cl. ..... 343/702; 343/700 MS; 343/767

(58) Field of Search ..... 343/702, 700 MS, 343/846, 848, 767

(56) References Cited

U.S. PATENT DOCUMENTS

| | | | | |
|---|---|---|---|---|
| 6,218,991 | B1 * | 4/2001 | Sanad | 343/700 MS |
| 6,366,243 | B1 * | 4/2002 | Isohatala et al. | 343/700 MS |
| 6,414,641 | B1 * | 7/2002 | Carlson et al. | 343/702 |
| 6,421,014 | B1 * | 7/2002 | Sanad | 343/700 MS |
| 6,573,869 | B2 * | 6/2003 | Moore | 343/702 |
| 2003/0052827 | A1 * | 3/2003 | Umehara et al. | 343/700 MS |

* cited by examiner

*Primary Examiner*—Tan Ho
(74) *Attorney, Agent, or Firm*—Holland & Hart

(57) ABSTRACT

The present invention relates to a non-rectangular shaped PIFA capable of dual ISM band operation using a single power feed. The dual frequency operation of the PIFA is accomplished by using a slot in the radiating element to quasi partition the radiating element. The dual band performance of the PIFA is realized through the integration of either the microstrip or the Co Planar Waveguide (CPW) feed line to the antenna structure.

46 Claims, 7 Drawing Sheets

| Plot Legend | Max Gain dBi | Avg Gain dBi | Max Angle deg |
|---|---|---|---|
| — Horse-Shoe Slot Circular PIFA Dualband PIFA test Boards, Free Az Plane 2450.0MHz; E-Phi Pol Tue May 14 15:00:47 2002 | 0.2 | -5.2 | 152.0 |
| — Horse-Shoe Slot Circular PIFA Dualband PIFA test Boards, Free Az Plane 2450.0MHz; E-Theta Pol Tue May 14 14:59:05 2002 | -1.6 | -5.9 | 115.9 |
| ---- Horse-Shoe Slot Circular PIFA Dualband PIFA test Boards, Free Az Plane 2450.0MHz; Total Field [V+H] Tue May 14 15:00:47 2002 | 0.3 | -2.5 | 152.0 |

| Plot Legend | Max Gain dBi | Avg Gain dBi | Max Angel deg |
|---|---|---|---|
| — Horse-Shoe Slot Circular PIFA Dualband PIFA test Boards, Free Az Pane 5250.0MHz; E-Theta Pol Tue May 14 15:01:58 2002 | -0.9 | -3.6 | 231.8 |
| — Horse-Shoe Slot Circular PIFA Dualband PIFA test Boards, Free Az Pane 5250.0MHz; E-Phi Pol Tue May 14 15:02:47 2002 | -1.4 | -6.2 | 41.9 |
| --- Horse-Shoe Slot Circular PIFA Dualband PIFA test Boards, Free Az Pane 5250.0MHz; Total Fields [V+H] Tue May 14 15:01:58 2002 | 1.0 | -1.7 | 41.9 |

CWT Rectangular Anechoic Chamber

COMPACT DUAL BAND CIRCULAR PIFA

The present application claims the benefit of United States Provisional Patent Application No. 60/390,027 filed Jun. 18, 2002, titled DUAL BAND CIRCULAR PIFA WITH INTEGRATED FEED LINE, which is incorporated herein by reference.

FIELD OF THE INVENTION

The present invention relates to Planar Inverted F-Antenna (PIFA), and more particularly, PIFA antenna with non-conventional shapes and an integrated feed line on a ground plane:

BACKGROUND OF THE INVENTION

In wireless radio frequency ("RF") data communications there is currently a shift in the requirement from the existing single band operation to dual industrial scientific medical ("ISM") band operation covering, for example, frequency ranges of 2.4–2.5 to 5.15–5.35 GHz. Generally, dual ISM band operation can be accomplished using either external or internal antennas. External antennas are large and susceptible to mechanical damage. Conversely, internal antennas are unseen by the user, smaller, and less susceptible to mechanical damage. However, internal antenna are constrained in effectiveness because of the size and volume restrictions associated with wireless devices In most of the devices, only specified regions with defined volume can accommodate the placement of internal antennas. These regions are usually not of perfect rectangular/square shape or of large size. At times, the available space for internal antennas nearly assumes a circular cylindrical shape of very small area and volume. For optimal performance of the internal antenna, it is desirable that the shape of the radiating structure of the antenna use as much of the allowed area as possible. Dual band ISM internal antenna, however, are generally rectangular in shape, which will be explained in connection with FIG. 9, below. Thus, it would be desirous to develop a non-conventionally shaped PIFA antenna to use more of the available space for internal antenna.

There seems to be no work reported on circular shaped either single or dual band PIFAs in open literature Wen-Hsiu Hsu and Kin-Lu Wong, "A Wideband Circular Patch Antenna", MICROWAVE AND OPTICAL TECHNOLOGY LETTERS, Vol. 25, No. 5, Jun. 5, 2000 pp. 328 (hereinafter referred to as Hsu et al) reports a dual band microstrip antenna with a circular radiating element using an air-substrate. The dual frequency operation of the microstrip antenna of Hsu et al is realized through two separate linear slots. The two slots are placed symmetrically with respect to the central axis of the radiating element. The axis of the microstrip feed line is also parallel to the axes of the slots.

A dual frequency circular microstrip antenna with a pair of arc-shaped slots has been studied in Kin-Lu Wong and Gui-Bin Hsieh, "Dual-Frequency Circular Microstrip Antenna with a Pair of Arc-Shaped Slots", MICROWAVE AND OPTICAL TECHNOLOGY LETTERS, Vol. 19, No. 6, Dec. 20 1998, pp. 410–412 (hereinafter referred to as Wong et al). The two arc-shaped slots are located on either side of one of the central axes. In the work of Wong et al, the two arc-shaped slots are also symmetrically placed with respect to the referred central axis of the antenna.

In both of the above research papers, the size of the radiating element corresponds to half wavelength at the center frequency of the lower resonant band.

Circular patch antennas also provide some insight into the present invention. The case studies of circular patches with a single arc or U-shaped slot are described in the work of K. M. Luk, Y. W. Lee, K. F Tong, and K. F. Lee, "Experimental studies of circular patches with slots", IEEE Proc.—Microw. Antennas Propagation, Vol. 144, No. 6, December 1997, pp. 421–424 (hereinafter referred to as Luk et al). With a single arc shaped slot, the choice of center or offset feed determines the dual or single frequency operation. The choice of a U-shaped slot, as in the paper of Luk et al, results only in a single band operation with a wider impedance bandwidth.

Recently there has been a drastic increase in the demand for use of internal antennas in wireless applications. In a variety of options for internal antennas, PIFAs seems to have a greater potential. Apart from extensive utility of PIFA in commercial cellular communications, PIFA continues to find its usefulness in many other systems applications such as WLAN, the Internet, or the like The printed circuit board of the communication device serves as the ground plane of the internal antenna. The PIFA is characterized by many distinguishing properties such as relative lightweight, ease of adaptation and integration into the device chassis, moderate range of bandwidth, versatile for optimization, and multiple potential approaches for size reduction. Its sensitivity to both the vertical and horizontal polarization is of immense practical importance in wireless devices because of multi path propagation conditions. All these features render the PIFA to be as good a choice as any internal antenna for wireless device applications. When it comes to diversity schemes, PIFAs have a unique advantage because it can be fashioned into varieties of either Polarization or pattern Diversity schemes.

A conventional single band PIFA assembly is illustrated in FIGS. 9A and 9B. The PIFA 110 shown in FIG. 9A and FIG. 9B consists of a radiating element 101, a ground plane 102, a connector feed pin 104*a*, and a conductive post or pin 107. A power feed hole 103 is located in radiation element corresponding to connector feed pin 104*a*. Connector feed pin 104*a* serves as a feed path for RF power to the radiating element 101. Connector feed pin 104*a* is inserted through the feed hole 103 from the bottom surface of the ground plane 102. The connector feed pin 104*a* is electrically insulated from the ground plane 102 where the pin passes through the hole in the ground plane 102. The connector feed pin 104*a* is electrically connected to the radiating element 101 at point 105*a* with, for example; solder. The body of the feed connector 104*b* is electrically connected to the ground plane at point 105*b* with, for example, solder The connector feed pin 104*a* is electrically insulated from the body of the feed connector 104*b*. A through hole 106 is located in radiation element 101 corresponding to conductive post or pin 107. Conductive post 107 is inserted through the hole 106. The conductive post 107 serves as a short circuit between the radiating element 101 and ground plane 102. The conductive post 107 is electrically connected to the radiating element 101 at point 108*a* with, for example, solder. The conductive post 107 is also electrically connected to the ground plane 102 at point, 108*b* with, for example, solder. The resonant frequency of the PIFA 110 is determined by the length (L) and width (W) of the radiating element 101 and is slightly affected by the locations of the feed pin 104*a* and the shorting pin 107. The impedance match of the PIFA 110 is achieved by adjusting the diameter of the connector feed pin 104*a*, by adjusting the diameter of the conductive shorting post 107, and by adjusting the separation distance between the connector feed pin 104*a* and the conductive shorting post 107. The fundamental limitation of the configuration of the PIFA 110 described in FIG. 9A and FIG. 9B is the requirement of relatively large dimensions of length (L) and width (W) of the radiating element 101 to achieve desired resonant frequency band. This configuration is limited to only single operating frequency band applications. If PIFA was a dual band PIFA, a slot (not shown) would reside in radiating element 101 to quasi partition the radiating element 101.

As represented by FIGS. 9A and 9B, the majority of PIFA designs focus on PIFA designs having a rectangular or square shape. Thus, it would be desirous to develop a compact dual ISM band internal PIFA having a non-conventional shapes.

SUMMARY OF THE INVENTION

This invention presents new schemes of designing circular shaped PIFAs with a small ground plane. Deviating distinctly from the routine and conventional feed structure usually employed in PIFA design, this invention also demonstrates that the RF feed line system can be integrated to the PIFAs.

To attain the advantages and in accordance with the purpose of the invention, as embodied and broadly described herein, planar inverted F antennas are disclosed. The planar inverted F antennas include non-rectangular radiating elements residing on a dielectric carriage, which in turn resides on a ground plane A slot in the radiating element quasi partitions the radiating element. A feed pin, conducting post, and matching stub are used to feed power to the radiating element and tune the PIFA to the appropriate frequency.

BRIEF DESCRIPTION OF THE DRAWINGS

The above and other objects and advantages of the present invention will be apparent upon consideration of the following detailed description, taken in function with the accompanying drawings, in which like reference characters refer like parts throughout, and in which.

DETAILED DESCRIPTION

Embodiments of the present invention are now explained with reference to the drawings. While the present invention is explained with reference to certain shapes, such as "Horse Shoe, U- or L-shaped slot," one of ordinary skill in the art will recognize on reading the disclosure that other shapes are possible, such as "C" shape, elliptical shape, bracket shape, or the like.

As mentioned above, some prior art designs provide some insight to the present invention. In particular, the following three publications related to prior art antennas are useful: Wen-Hsiu Hsu and Kin-Lu Wong, "A Wideband Circular Patch Antenna", MICROWAVE AND OPTICAL TECHNOLOGY LETTERS, Vol. 25, No. 5, Jun. 5, 2000 pp. 328, Kin-Lu Wong and Gui-Bin Hsieh, "Dual-Frequency Circular Microstrip Antenna with a Pair of Arc-Shaped Slots", MICROWAVE AND OPTICAL TECHNOLOGY LETTERS, Vol. 19, No. 6, Dec. 20, 1998, pp.410–412, and K. M. Luk, Y. W. Lee, K. F. Tong, and K. F. Lee, "Experimental Studies Of Circular Patches With Slots", IEEE Proc.—Microw. Antennas Propagation., Vol. 144, No. 6, December 1997, pp. 421–424. Hsu et al. and Wong et al., describe a microstrip antenna where the size of the radiating element corresponds to half wavelength at the center frequency of the lower resonant band. Unlike the Hus et al. and Wong et al. antennas, however, the present invention uses a single slot to yield dual frequency operation of circular PIFA. Further, because of the shorting post associated with the PIFA, the size of the radiating element of the circular PIFA of this invention corresponds only to quarter wavelength or less at the center frequency of the lower resonant band.

The present invention uses a U-shaped slot as in Luk et al However, the circular patch antenna of Luk et al. has single band operation with a wider Impedance bandwidth. The present invention employs a single slot to exhibit dual frequency operation. The dual frequency operation of the circular PIFA has been demonstrated with other slot shapes as well, such as, for example, a single arc shaped slot. Further, unlike Luk et al., the dual band operation of the circular PIFA of this invention has been accomplished with a radiating element of quarter wavelength in size corresponding to the mid frequency of the lower band. Finally, the present invention can use a relatively smaller ground plane, such as, for example ground planes ranging from sizes of 30 to 45 mm (L) by 25 to 30 mm (W) thereby accomplishing the compactness of the overall PIFA structure.

Figure 1:
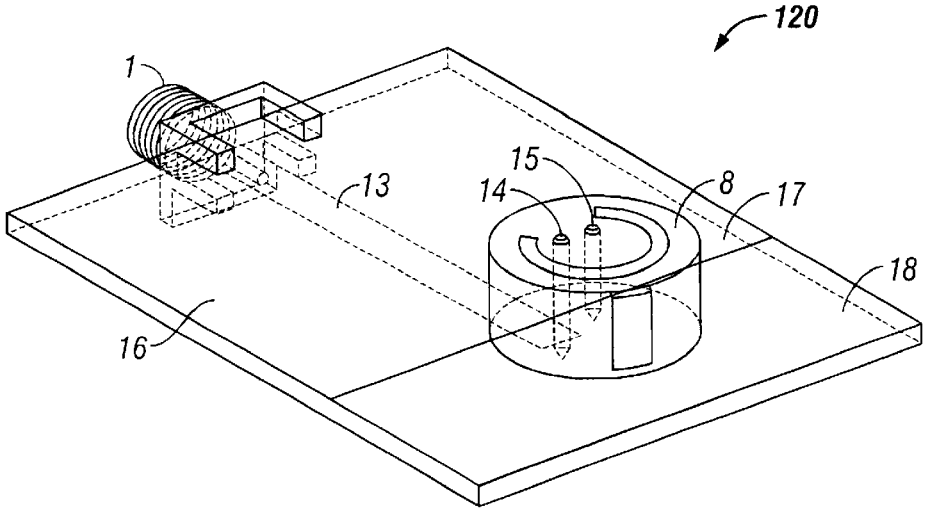
FIG. 1 is perspective view of a planar inverted F antenna illustrative of an embodiment of the present invention.
Figure 6:
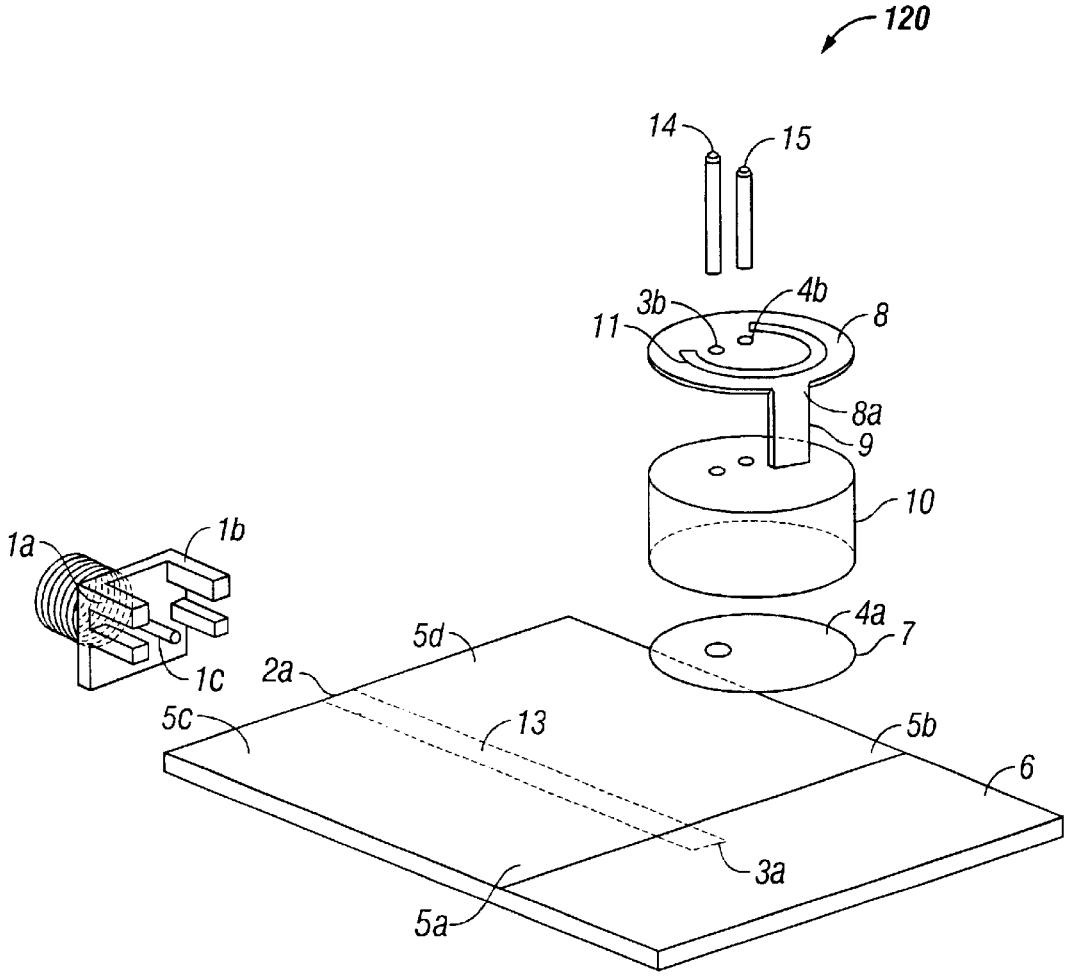
FIG. 6 is an exploded view of PIFA 120 associated with Figure 1.

Referring specifically to FIGS. 1 and 6, a PIFA 120 illustrative of a first embodiment of the present invention is shown. PIFA 120 has a radio frequency (RF) power connector 1, a ground plane 7, a radiating element 8, a dielectric carriage 10, a slot 11, a microstrip feed line 13, and a printed circuit board (PCB) 16. PCB 16 has a metallic region 17 and a non-metallic region 18. Dielectric carriage 10 could be many types of dielectric material, such as, for example, an air gap, high density polyethylene, acrolonitrite butadiene styrene, polycarbonates, and the like. Generally, it has been found that dielectric materials with a dielectric contrast in the range of about 2.5 to about 3.5 work well Establishing PCB 16 with metallic and nonmetallic regions is largely a function of design choice. PIFA 120 resides on PCB 16 such that a portion of PIFA 120 is aligned with both metallic (17) and non-metallic (18) regions. PIFA. 120 is shown with a majority of the radiating element existing over non-metallic region 18. It is possible to arrange PIFA 120 so more or less of the radiating element resides over non-metallic region 1-8. Generally, PIFA 120 works better when more of the radiating element is over non-metallic region 18. In PIFA 120, while the microstrip feed 13 is on the bottom surface of the PCB 16, the metallic region 17 is on the top-surface of PCB 16.

While power connector 1 can be any number of equivalent connector, it has been found that a SMA connector is useful. The SMA connector has a center conductor 1*c* and outer conductors 1*a* and 1*b*. As shown in FIG. 6, center conductor 1*c* is attached, such as by soldering, to a first end 2*a* of microstrip 13. A second end 3*a* of microstrip 13 is attached, such as by soldering, to a feed pin 14. Feed pin 14, which extends through via holes in ground plane 7 and dielectric carriage 10 (via holes not specifically labeled but shown in FIG. 6), is connected to radiating element 8 to provide RF power.

Connector 1 generally also has outer conductors 1*a* and 1*b*. Outer conductors 1*a* and 1*b* are attached, such as by soldering, to PCB 16, such as at first solder point 5*c* and second solder point 5*d* are normally arranged such that they are symmetrical with respect to the central axis of the microstrip feed line 13 The locations of first solder point 5*c* and second solder point 5*d* are such that they are symmetrical with respect to the central axis of the microstrip feed line 13.

As best seen in FIG. 6, and describing from PCB 16 to radiating element 8, ground plane 7 resides on PCB 16 such that the feed via hole in ground plane 7 aligns with second end 3*a* of microstrip 13. At least third solder point 5*a* and fourth solder point 5*b* connect ground plane 7 to PCB 16.

Figure 2:
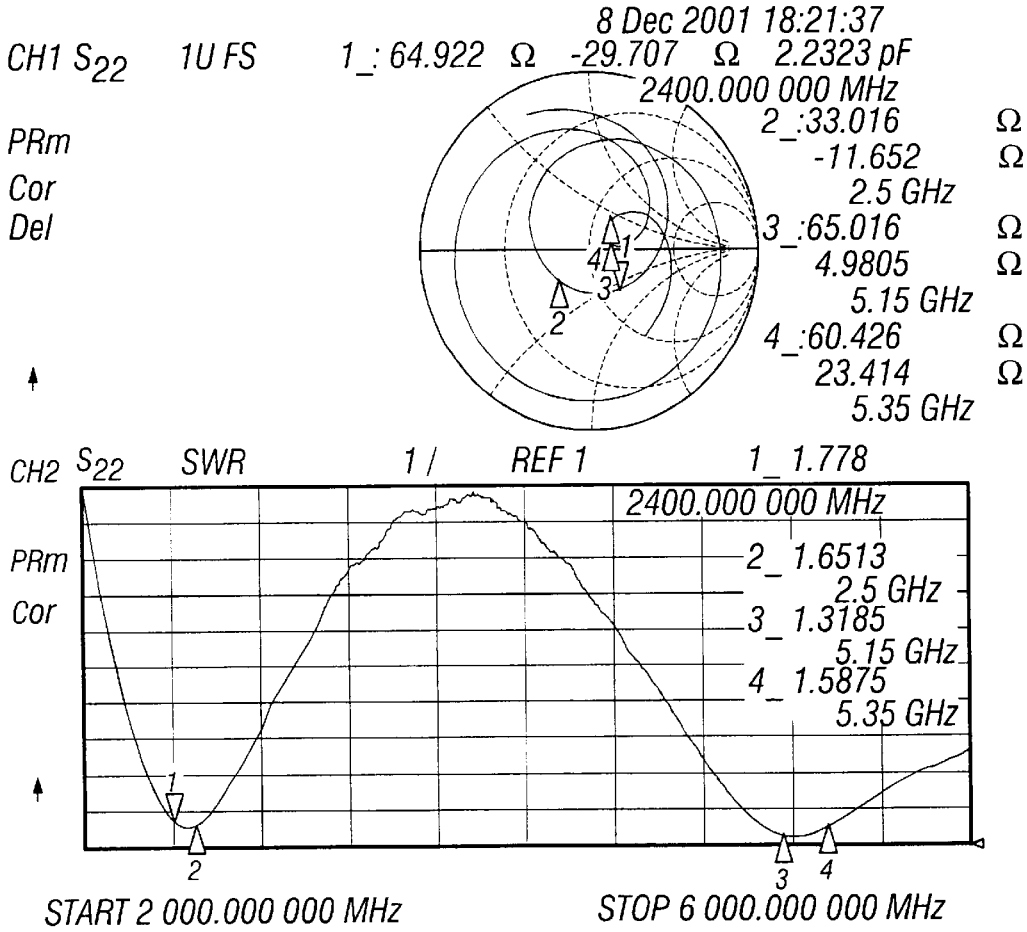
FIG. 2 is a frequency-response that depicts the characteristics of a particular PIFA constructed in accordance with an embodiment of the present invention.
Figure 3A:
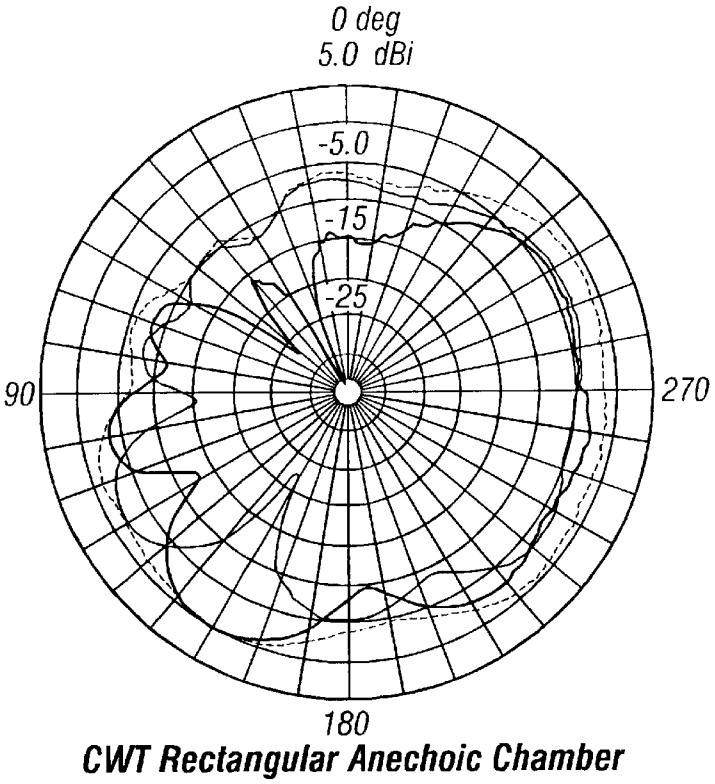
FIGS. 3*a* and 3*b* are measured radiation patterns of the PIFA associated with FIG. 2 for RF frequencies of 2450 and 5250 MHz, respectively.
Figure 3B:
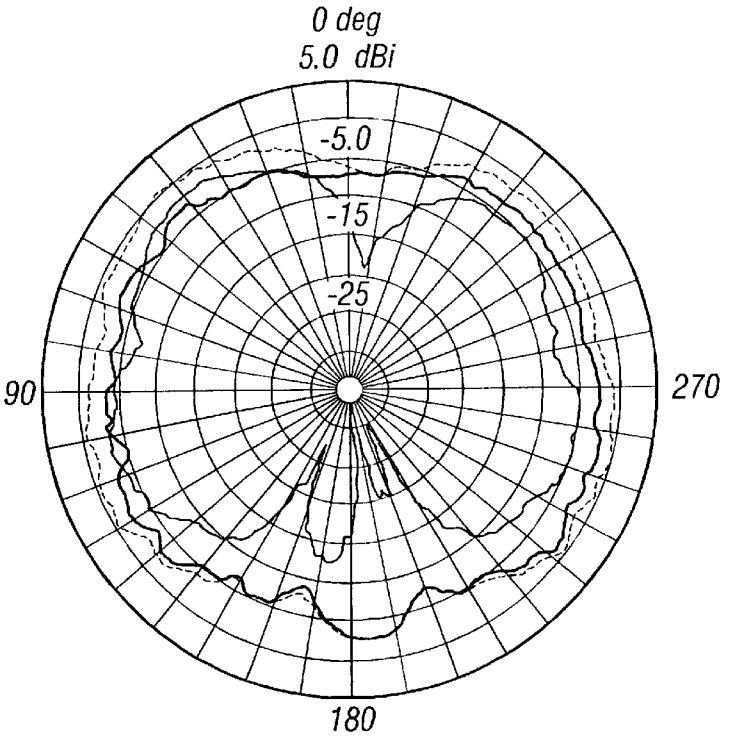

Radiating element 8 contains slot 11, a conducting post 15, and a matching stub 9. Slot 11, which is a horse-shoe shaped slot, can be located in a number of locations to quasi partition radiating element 8. Slot 11 is formed on the radiating element 8 by making a trace from a point located on the left hand side of feed pin 14 to a point positioned on the right hand side of conducting post 15. In this case, slot 11 has an arc of about 270 degrees, but the arc could be from about 180 degrees to about 300 degrees depending on the placement of the feed pin and conducting post. Conducting post 15 is attached to radiating element 8 and extends through a via hole in dielectric carriage 10. Conducting post 15 is connected to ground plane 7, but not microstrip 13 (i.e., conducting post 15 is grounded). Matching stub 9 attached to radiating element 8 at 8*a* also extends along the outer sidewall of the dielectric carriage 10 without attaching to ground plane 7. As one of skill in the art would recognize on reading the disclosure, the size, shape and placement of slot 11, feed pin 14, conducting post 15, and matching stub 9 control the operation frequencies of the dual band ISM PIFA. In particular, controlling the arc radius of slot 11 (more or less arc radius) has a pronounced effect on the upper frequency of PIFA 120. The lower frequency is generally tunable by varying the dimensions and placement of the matching stub 9. The locations as well as the sizes of the conducting post 15 and feed pin 14 have small effects on resonant frequencies of PIFA 120. FIGS. 2, 3*a* and 3*b* show plots of VSWR and gain of PIFA 120 with a radius of 7.5 mm and height of 7.5 mm. The radius and height can vary between 4 to 10 mm for radius and 4 to 8 mm for height. Also, the radius and height do not have to be equal.

Figure 4:
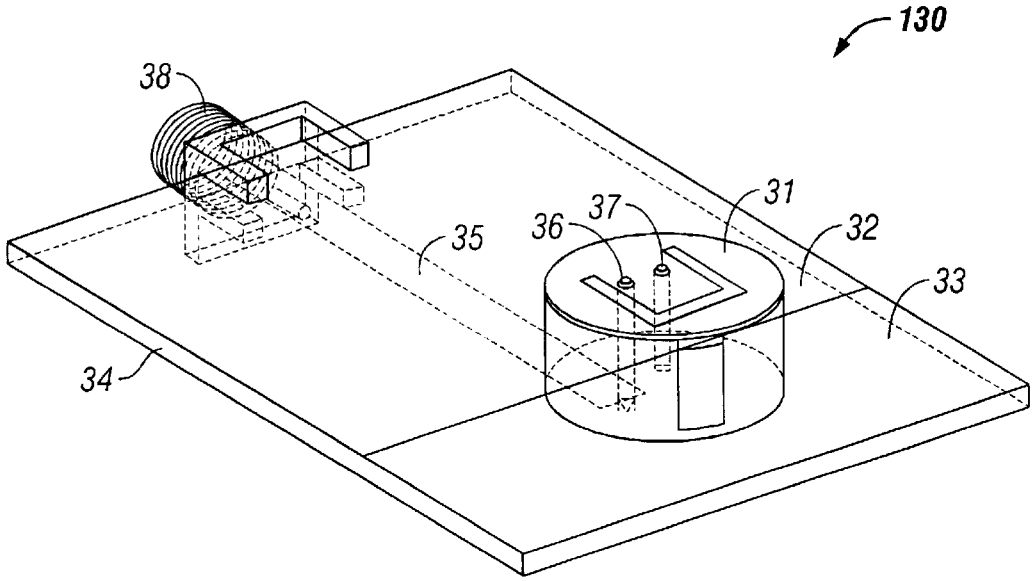
FIG. 4 is a perspective view of a planar inverted F antenna illustrative of another embodiment of the present invention.
Figure 7:
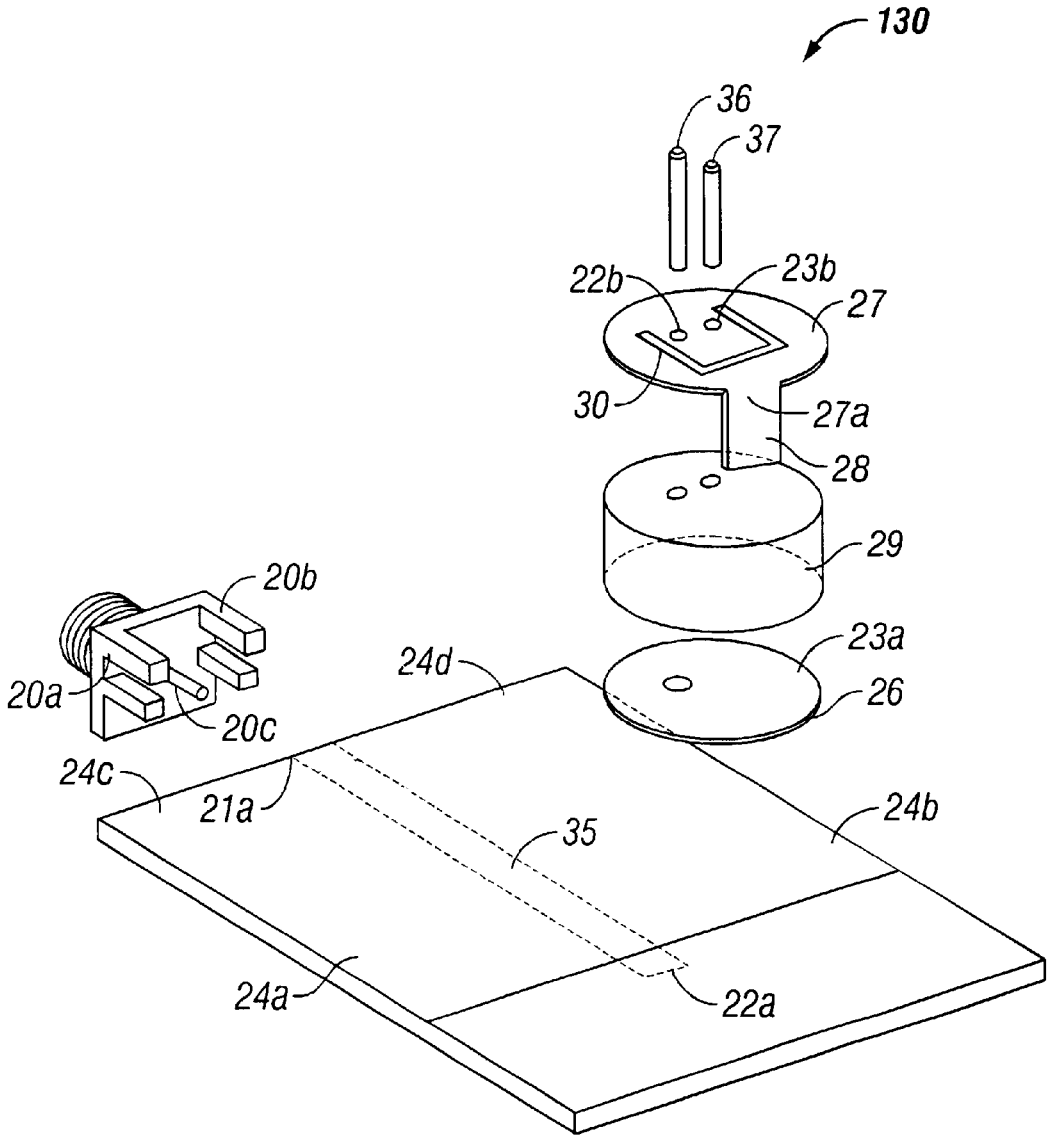
FIG. 7 is an exploded view of PIFA 130 associated with FIG. 4.

Referring to FIGS. 4 and 7, a PIFA 130 illustrative of a second embodiment of the present invention is shown. PIFA 130 is similar to PIFA 120, however, PIFA 130 has,an alternative slot design. As one of skill in the art would recognize on reading this disclosure, the circular PIFA can have many slot configurations and the slots shown in the figures are exemplary and non-limiting.

In particular, PIFA 130 has a connector 38, a microstrip 35, a PCB 34, a ground plane 26, a dielectric carriage 29, a radiating element 27, a slot 30, a feed pin 36, a conducting post 37, a matching stub 28. PCB 34 has a metallic region 32 and a non-metallic region 33, PIFA 130 resides on PCB 34 such that a portion of PIFA 130 is aligned with both metallic (32) and non metallic (33) regions. PIFA 130 is shown with a majority of the radiating element existing over non-metallic region 33. It is possible to arrange PIFA 130 so more or less of the radiating element resides over non-metallic region 33. Generally, PIFA 130 works better when more of the radiating element is over non-metallic region 33.

Referring to FIG. 7 and using an exemplary SMA connector for power connector 38, a center conductor 20*c* is attached to a first end 21*a* of microstrip 35. Outer conductors 20*a* and 20*b* are attached to PCB 34 at points 24*c* and 24*d*. A second end 22*a* of microstrip 35 is attached, such as by soldering, to a feed pin 36. Feed pin 36, which extends through via holes in ground plane 26 and dielectric carriage 29 (via holes not specifically labeled but shown in. FIG. 7), is connected to radiating element 27 to provide RF power.

Outer conductors 20*a* and 20*b* are attached, such as by soldering, to PCB 34, such as at first solder point 24*c* and second solder point 24*d*. The locations of solder points 24*c* and 24*d* are such that they are symmetrical with respect to the central axis of the microstrip feed line 35.

As best seen in FIG. 7, ground plane 26 resides on PCB 34 such that the feed via hole in ground plane 26 aligns with second end 22*a* of microstrip 35. At least third solder point 24*a* and fourth solder point 24*b* connect ground plane 26 to PCB 34.

Radiating element 27 contains slot 30, a conducting post 37, and a matching stub 28. Slot 30, which in this case is a is a "U" or bracket shaped slot, can be located in a number of locations to quasi partition radiating element 27. Slot 30 is formed on the radiating element 27 such that the contour of the slot is positioned away from the center of the circular PIFA. The placement of the U-shaped slot is determined by the positions of feed and shorting posts. The length and the width of the U-shaped slot as well as its relative positions with respect to the locations of the feed/shorting posts are determined by the desired frequency tuning. In the embodiment shown, the line connecting the feed post and the shorting post is internal to the profile of the U-shaped slot. Conducting post 37 is attached to radiating element 27 and extends through a via hole in dielectric carriage 29. Conducting post 37 is connected to ground plane 26, but not microstrip 35 (i.e., conducting post 37 is grounded). Matching stub 28 attached to radiating element 27 at 27*a* also extends along the sidewall of the dielectric carriage 29 without attaching to ground plane 26. As one of skill in the art would recognize on reading the disclosure, the size, shape and placement of slot 30, feed pin 36 conducting post 37, and matching stub 28 control the operation frequencies of the dual band ISM PIFA. In particular, controlling the placement and size of slot 30 has a pronounced effect on the upper resonant frequency of PIFA 130. The lower resonant frequency is generally tunable by varying the dimensions and placement of the matching stub 28. The locations as well as sizes of the conducting post 37 and feed pin 36 have small effects on resonant frequencies of PIFA 130. The radius and height for PIFA 130 can vary between 4 to 10 mm for radius and 4 to 8 mm for height. Also, the radius and height do not have to be equal.

Figure 5:
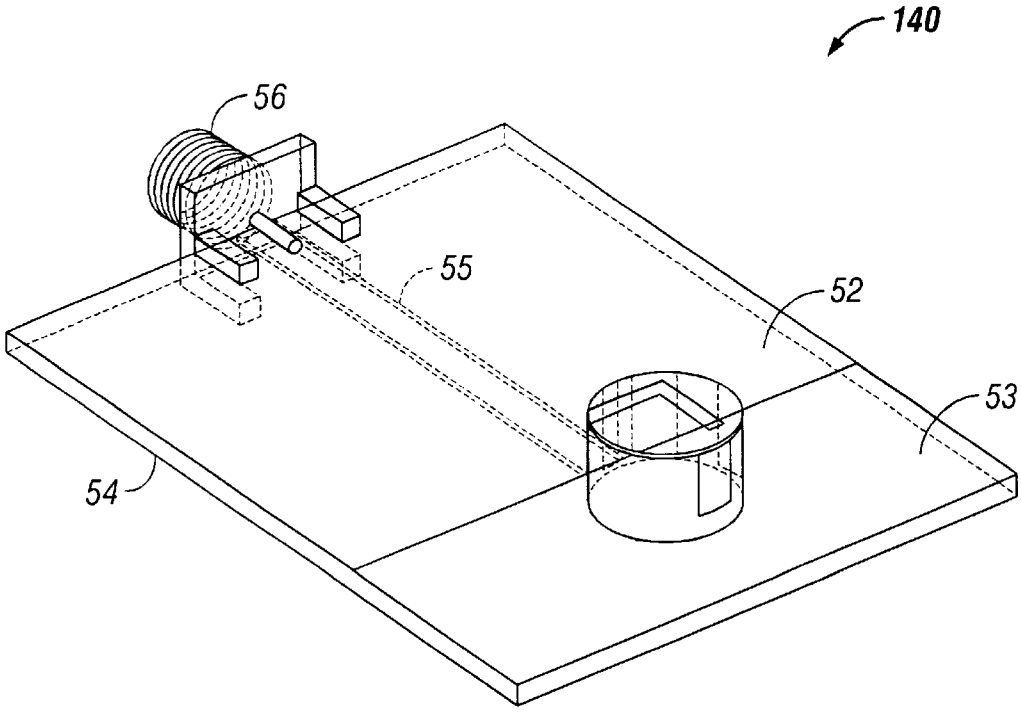
FIG. 5 is a perspective view of a planar inverted F antenna illustrative of another embodiment of the present invention.
Figure 8:
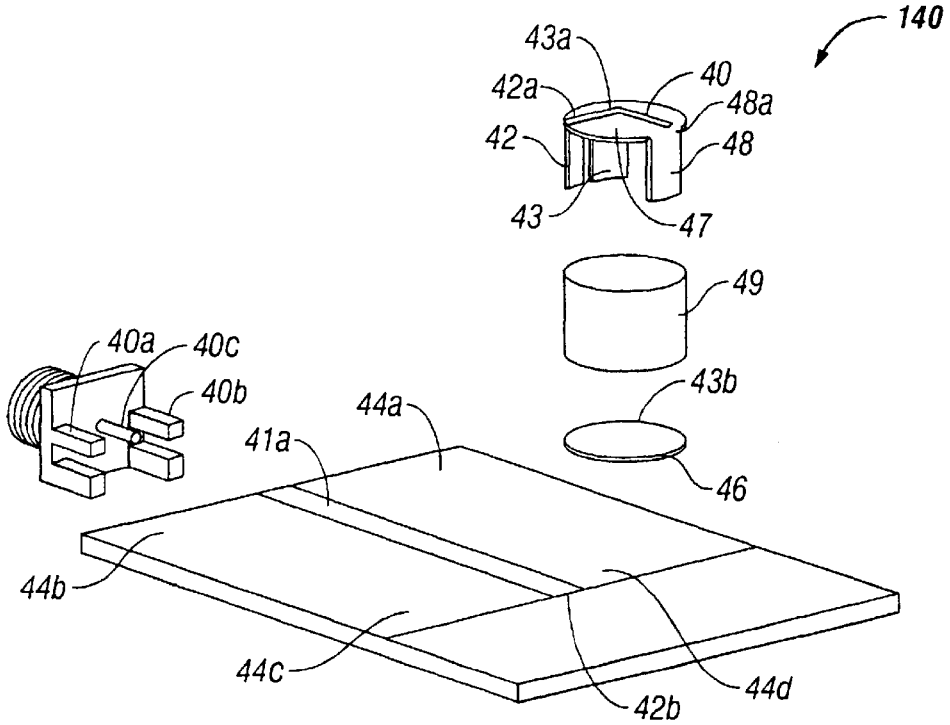
FIG. 8 is an exploded view of PIFA 140 associated with FIG. 5
Figure 9A:
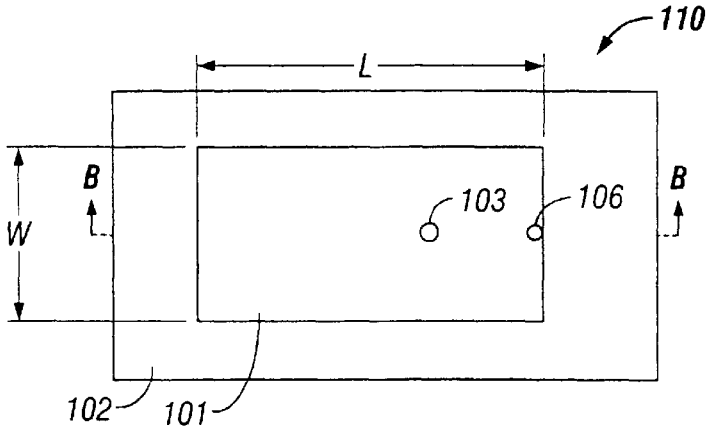
FIG. 9A (Prior Art)
FIG. 9*a* is a top view of a prior art single band PIFA.
Figure 9B:
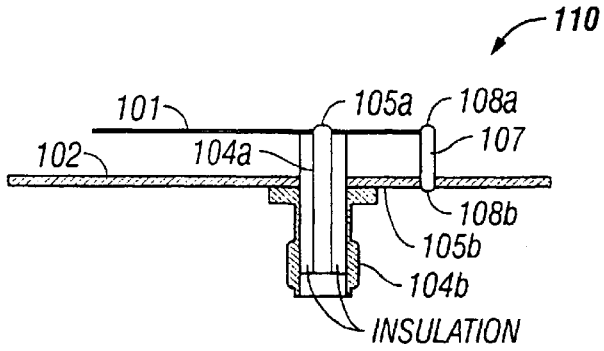
FIG. 9B (Prior Art)
FIG. 9*b* is a sectional view the FIG. 9*a* prior art PIFA.

Referring now to FIGS. 5 and 8, PIFA 140 of a third embodiment of the present invention will be described. PIFA 140 is similar to PIFAs 120 and 130. But unlike PIFAs 120 and 130, PIFA 140 eliminates the via holes in the ground plane by strategic locations of the feed pin, shorting post and the choice of the Co Planar Waveguide (CPW) feed line instead of microstrip feed line, as explained below.

PIFA 140 comprises a connector 56, a PCB 54, CPW 55, a radiating element 47, a dielectric carriage 49, and a ground plane 46. PCB 54 contains a metallic region 52 an d a non-metallic region 53. In this example, PIFA 140 resides on non-metallic region 53 of PCB 54. The CPW 55, thus, extends from the connector 56 over the metallic region 52 to the interface between the metallic region 52 and non-metallic region 53. It would be possible to arrange PIFA 140 with portions over metallic region 52. But in this configuration, it has been shown that PIFA 140 works better when it resides over the non-metallic portion of PCB 54.

As shown best in FIG. 8, and again using the standard SMA connector for connector 56, a center conductor 40*c* is attached to a first end 41*a* of CPW 55. Outer conductors 40*a* and 40*b* of the RF connector 56 are attached to PCB 54 at first solder point 44*a* and second solder point 44*b*. A second end 42*b* of CPW 55 is connected to feed strip 42. Feed strip 42 extends along the sidewall of the dielectric carriage 49 and is connected to radiating element 47. Because feed strip 42 extends along the sidewall of carriage dielectric 49, the via holes in ground plane 46 and dielectric carriage 49 can be eliminated. Similarly, a conducting post 43 is attached to the radiating element 47, extends along the sidewall of the dielectric carriage 49, to be attached to ground plane 46. A matching stub 48 also attached to radiating element 47 extends along the outer wall of the dielectric carriage 49. The feed strip 42, the conducting post 43 and the matching stub 48 are in flush with the sidewall of the dielectric carriage 49.

Slot 40 is L-shaped. The segment of the L-shaped slot 40 with an opening or gap (open end) in the circumference of the radiating element forms the horizontal section of the L-slot. The axis of the horizontal section of the L-slot is perpendicular to the axis of the CPW 55. The vertical section of the L-slot 40 has a closed end. The axis of the vertical section of the L-slot is parallel to the axis of the CPW 55. As one of skill in the art would recognize on reading the disclosure, the size, shape, and placement of slot 40, feed strip 42, conducting post 43, and matching stub 48 control the operation frequencies of the dual ISM band PIFA 140. The radius and height for PIFA 140 can vary between 4 to 8 mm for radius and 4 to 8 mm for height. Also, the radius and height do not have to be equal.

While the invention has been particularly shown and described with reference to embodiments thereof, it will be understood by those of ordinary skill in the art that various other changes in the form and details may be made without departing from the spirit and scope of the invention. Further, while particular configurations of the present invention have been illustrated and described, other configurations are possible.

We claim:

1. A planar inverted F antenna comprising:

a non-rectangular radiating element comprising an internal side, an external side, and a peripheral edge;

a dielectric carriage comprising a radiating side, a ground side, and at least one sidewall;

the non-rectangular radiating element resides on the dielectric carriage such that the internal side of the radiating element resides closer to the radiating side of the dielectric carriage;

a ground plane comprising a feed side and a carriage side;

the dielectric carriage resides on the ground plane such that the carriage side of the ground plane resides closer to the ground side of the dielectric carriage;

a slot;

the slot resides in the internal side of the radiating element;

a feed pin;

the feed pin attached to the internal side of the radiating element;

a dielectric carriage feed pin via hole;

a ground plane feed pin via hole;

the feed pin extends from the internal side of the radiating element through the dielectric carriage feed pin via hole and the ground plane feed pin via hole and is adapted to attach to a microstrip feed line;

a conducting post;

the conducting post attached to the internal side of the radiating element;

a dielectric carriage conducting post via hole;

the conducting post extends from the internal side of the radiating element to the carriage side of the ground plane through the dielectric carriage conducting post via hole and is attached to the dielectric side of the ground plane;

a matching stub;

the matching stub attached to the peripheral edge of the radiating element; and the matching stub has a downward extension from the peripheral edge of the radiating element and the matching stub not touching the ground plane;

the matching stub is in flush with the sidewall of the dielectric carriage; and the matching stub has a downward extension from the peripheral edge of the radiating element, such that the matching stub resides off the ground plane and is flush with the sidewall of the dielectric carriage.

2. The antenna of 1, further comprising:

a microstrip feed;

a substrate;

the microstrip feed comprises a ground plane side and a substrate side;

the microstrip feed line extends over the substrate to the ground plane such that the substrate side of the microstrip feed resides closer to the substrate and the ground plane side resides closer to the ground plane; and the microstrip feed line is attached to the feed pin at a point aligned with the ground plane feed pin via hole.

3. The antenna of claim 1, wherein the substrate comprises a printed circuit board having a metallic region and a non-metallic region.

4. The antenna of claim 3, wherein the radiating element is positioned such that parts of the radiating element reside over both the metallic region and the non-metallic region of printed circuit board, where the ground plane of the antenna is connected to the metallic region of the printed circuit board at selective points.

5. The antenna of claim 3, wherein the radiating element is positioned such that a greater part of the radiating element resides over the non-metallic region of printed circuit board.

6. The antenna of claim 3, wherein the radiating element is positioned such that a greater part of the radiating element resides over the metallic region of printed circuit board.

7. The antenna of claim 1, wherein the non-rectangular radiating element has a shape comprising at least one of circular, semi-circular, elliptical, and semi-elliptical.

8. The antenna of claim 1, wherein the non-rectangular radiating element has a non-geometric, irregular shape.

9. The antenna of claim 1, wherein the dielectric carriage comprises at least one of HDPE (High Density Poly Ethylene), ABS (Acrolonitrite Butadiene Styrene), and Polycarbonate.

10. The antenna of claim 9, wherein the dielectric carriage has a dielectric constant of about 2.5 to about 3.5.

11. The antenna of claim 1, wherein the slot comprises at least one of a horse-shoe shape, a bracket shape, a U-shape, a L-shape, a T-shape, and an inclined shape.

12. The antenna of claim 11, wherein the slot partitions the radiating element to allow for dual ISM band operation.

13. The antenna of claim 11, wherein the slot is the horseshoe shape slot and the horse-shoe shape arcs from a first point in line with where the feed pin is attached to the radiating element to a second point in line with where the conducting post is attached to the radiating element.

14. The antenna of claim 13, where the arc ranges from about 180 degrees to about 270 degrees.

15. The antenna of claim 1, wherein an electrical size of the antenna is about a quarter wave-length at the mid frequency of the lower resonant band.

16. A planar inverted F antenna comprising:

a non-rectangular radiating element comprising an internal side, an external side and a peripheral edge;

a dielectric carriage comprising a radiating side, a ground side, and at least one sidewall;

the non-rectangular radiating element resides on the dielectric carriage such that the internal side of the radiating element resides closer to the radiating side of the dielectric carriage;

a ground plane comprising a feed side and a carriage side;

the dielectric carriage resides on the ground plane such that the carriage side of the ground plane resides closer to the ground side of the dielectric carriage;

a horse-shoe shaped slot;

a feed pin;

the feed pin attached to the internal side of the radiating element;

a dielectric carriage feed pin via hole;

a ground plane feed pin via hole;

the feed pin extends from the internal side of the radiating element through the dielectric carriage feed pin via hole and the ground plane feed pin via hole and is adapted to attach to a microstrip feed line;

a conducting post;

the conducting post attached to the internal side of the radiating element;

a dielectric carriage conducting post via hole;

the conducting post extends from the internal side of the radiating element to the carriage side of the ground plane through the dielectric carriage conducting post via hole and is attached to the dielectric side of the ground plane;

the first point lies to the left of the feed pin and the second point is located to the right of the conducting post;

the horse-shoe shaped slot extends in an arc from a first point in line with the feed pin to a second point in line with the conducting post;

a matching stub;

the matching stub attached to the peripheral edge of the radiating element; and the matching stub has a downward extension from the peripheral edge of the radiating element, such that the matching stub not touching the ground plane and is in flush with the sidewall of the dielectric carriage.

17. The antenna of claim 16, further comprising:

a microstrip feed;

a substrate;

the microstrip feed comprises a ground plane side and a substrate side;

the microstrip feed line extends over the substrate to the ground plane such that the substrate side of the microstrip feed resides closer to the substrate and the ground plane side resides closer to the ground plane; and the microstrip feed line is attached to the feed pin at a point aligned with the ground plane feed pin via a hole.

18. The antenna of claim 17, wherein the substrate comprises a printed circuit board having a metallic region and a non-metallic region, where the ground plane of the antenna is connected to the metallic region of the printed circuit board at selective points.

19. The antenna of claim 18, wherein the radiating element resides in proximity to an interface between the metallic region and the non-metallic region of printed circuit board.

20. The antenna of claim 17, wherein the slot partitions the radiating element to allow for dual ISM band operation.

21. The antenna of claim 17, wherein the radiating element has an unbroken circumference.

22. The antenna of claim 17, wherein the horse-shoe shaped slot forms an arc from a first point in line with where the feed pin is attached to the radiating element to a second point in line with where the conducting post is attached to the radiating element.

23. The antenna of claim 17, wherein the feed pin, the conducting post, and matching stub are attached using solder.

24. The antenna of claim 17, wherein an electrical size of the antenna is about a quarter wave-length at the mid frequency of the lower resonant band.

25. The antenna of claim 17, wherein the non-rectangular radiating element has a shape comprising at least one of circular, semi-circular, elliptical, and semi-elliptical.

26. The antenna of claim 17, wherein the non-rectangular radiating element has a non-geometric, irregular shape.

27. A planar inverted F antenna comprising:

a non-rectangular radiating element comprising an internal side and an external side and a peripheral edge;

a dielectric carriage comprising a radiating side, a ground side, and at least one sidewall;

the non-rectangular radiating element resides on the dielectric carriage such that the internal side of the radiating element resides closer to the radiating side of the dielectric carriage;

a ground plane comprising a feed side and a carriage side;

the dielectric carriage resides on the ground plane such that the carriage side of the ground plane resides closer to the ground side of the dielectric carriage;

a "U" shaped slot;

a feed pin;

the feed pin attached to the internal side of the radiating element;

a dielectric carriage feed pin via hole;

a ground plane feed pin via hole;

the feed pin extends from the internal side of the radiating element through the dielectric carriage feed pin via hole and the ground plane feed pin via hole and is adapted to attach to a microstrip feed line;

a conducting post;

the conducting post attached to the internal side of the radiating element;

a dielectric carriage conducting post via hole;

the conducting post extends from the internal side of the radiating element to the carriage side of the ground plane through the dielectric carriage conducting post via hole and is attached to the dielectric side of the ground plane;

a matching stub;

the matching stub attached to the peripheral edge of the radiating element; and the matching stub has a downward extension from the peripheral edge of the radiating element such that the matching stub resides off the ground plan and is in flush with the sidewall of the dielectric carriage.

28. The antenna of claim 27, further comprising:

a microstrip feed;

a substrate;

the microstrip feed comprises a ground plane side and a substrate side;

the microstrip feed line extends over the substrate to the ground plane such that the substrate side of the microstrip feed resides closer to the substrate and the ground plane side resides closer to the ground plane; and the microstrip feed line is attached to the feed pin at a point aligned with the ground plane feed pin via a hole.

29. The antenna of claim 27, wherein the substrate comprises a printed circuit board having a metallic region and a non-metallic region. The ground plan of the antenna is connected to the metallic region of the printed circuit board at selective points.

30. The antenna of claim 29, wherein the radiating element resides in proximity to an interface between the metallic region and the non-metallic region of the printed circuit board.

31. The antenna of claim 27, wherein the slot partitions the radiating element to allow for dual ISM band operation.

32. The antenna of claim 27, wherein the radiating element has an unbroken circumference.

33. The antenna of claim 27, wherein the U-shaped slot has first and second vertical segments and a horizontal segment;

the first and second vertical segments of the U-shaped slot are parallel to each other;

the first and second vertical segments of the U-shaped slots are on either side of the horizontal segment of the U-shaped slot;

the first vertical segment of the U-shaped slot on the internal side of the radiating element is generally perpendicular to the line containing the feed pin and conducting post;

the horizontal segment of the U-shaped slot extends from said first vertical segment of the U-shaped slot generally parallel to the line containing the feed pin and the conducting post;

the second vertical segment of the U-shaped slot extends from said horizontal segment of the U-shaped slot generally perpendicular to the line containing the feed pin and the conducting post;

the axis of the horizontal segment of the U-shaped slot is parallel to the line containing the feed pin and the conducting post;

the axes of the first and second vertical segments of the U-shaped slot are perpendicular to the axis of the horizontal segment of the U-shaped slot;

the U-shaped slot resides in the internal side of the radiating element such that the horizontal segment of the U-shaped slot is above the line containing the feed pin and the conducting post; and the U-shaped slot resides in the internal side of the radiating element such that the first and second vertical segments are outside the line connecting the feed pin and the conducting post.

34. The antenna of claim 27, wherein an electrical size of the antenna is about a quarter wave-length at the mid frequency of the lower resonant band.

35. The antenna of claim 27, wherein the non-rectangular radiating element has a shape comprising at least one of circular, semi-circular, elliptical, and semi-elliptical.

36. The antenna of claim 27, wherein the non-rectangular radiating element has a non-geometric, irregular shape.

37. A planar inverted F antenna, comprising:

a non-rectangular radiating element comprising an internal side, an external side, and a peripheral edge;

a dielectric carriage comprising a radiating side, a ground side, and at least one sidewall; and the non-rectangular radiating element resides on the dielectric carriage such that the internal side of the radiating element resides closer to the radiating side of the dielectric carriage;

a ground plane comprising a feed side, a carriage side, and a ground plane edge;

the dielectric carriage resides on the ground plane such that the carriage side of the ground plane resides closer to the ground side of the dielectric carriage;

a slot;

the slot resides in the internal side of the radiating element;

a feed strip;

the feed pin attached to the peripheral edge of the radiating element;

the feed pin extends from the peripheral edge along the at least one sidewall towards the ground plane edge and is adapted to be attached to a Co Planar Waveguide;

a conducting post;

the conducting post attached to the peripheral edge;

the conducting post extends from the peripheral edge along the at least one sidewall and is attached to the ground plane edge;

a matching stub;

the matching stub attached to the peripheral edge;

the matching stub extends from the peripheral edge along the at least one sidewall; and the matching stub is in flush with the sidewall of the dielectric carriage.

38. The antenna of 37, further comprising:

a CPW feed;

a substrate;

the CPW feed comprises a ground plane side and a substrate side;

the CPW feed line extends over the substrate to the ground plane such that the substrate side of the CPW feed resides closer to the substrate; and the CPW feed line is attached to the feed pin at the ground plane edge.

39. The antenna of claim 38, wherein the substrate comprises a printed circuit board having a metallic region and a non-metallic region, where the ground plane of the antenna is connected to the metallic region of the printed circuit board at selective points.

40. The antenna of claim 38, wherein the radiating element resides in proximity to an interface between the metallic region and the non-metallic region of printed circuit board.

41. The antenna of claim 37, wherein the slot partitions the radiating element to allow for dual ISM band operation.

42. The antenna of claim 37, wherein the slot forms a gap in a circumference of the radiating element.

43. The antenna of claim 37, wherein the slot is "L" shaped, the L-shaped slot has a vertical segment and a horizontal segment;

the horizontal segment of the L-shaped slot has an open end or gap located on the peripheral edge of the radiating element;

the vertical segment of the L-shaped slot has a closed end located on the internal side of the radiating element; and the vertical segment of the L-shaped slot extends from said horizontal segment of the L-shaped slot such that the axes of vertical and horizontal segments of the L-shaped slot are nearly perpendicular to each other.

44. The antenna of claim 37, wherein an electrical size of the antenna is smaller than a quarter wave length at the mid frequency of the lower resonant band.

45. The antenna of claim 37, wherein the non-rectangular radiating element has a shape comprising at least one of circular, semi-circular, elliptical, and semi-elliptical.

46. The antenna of claim 37, wherein the non-rectangular radiating element has a non-geometric, irregular shape.

* * * * *